US006112706A

United States Patent [19]

Heer

[11] Patent Number: 6,112,706

[45] Date of Patent: Sep. 5, 2000

[54] COOLING SYSTEM FOR MOTOR VEHICLES

[75] Inventor: Siegfried Heer, Kirchdorf/Krems, Austria

[73] Assignee: TCG Unitech Aktiengesellschaft, Kirchdorf/Krems, Austria

[21] Appl. No.: 09/187,042

[22] Filed: Nov. 6, 1998

[30] Foreign Application Priority Data

Nov. 6, 1997 [AT] Austria ..... 695/97 U

[51] Int. Cl.[7] ..... F01P 5/10; F01P 7/16

[52] U.S. Cl. ..... 123/41.1; 236/34.5; 123/41.44

[58] Field of Search ..... 123/41.1, 41.44, 123/41.47, 101 C, 41.09, 41.08; 417/295; 236/34.5

[56] References Cited

U.S. PATENT DOCUMENTS

| | | | |
|---|---|---|---|
| 2,871,836 | 2/1959 | Doughty | 123/41.1 |
| 4,748,941 | 6/1988 | Kashiwase | 123/41.1 |
| 4,938,185 | 7/1990 | Doke | 123/195 C |
| 5,289,803 | 3/1994 | Matsuhiro et al. | 236/101 C |
| 5,329,888 | 7/1994 | Luckett et al. | 236/34.5 |
| 5,715,776 | 2/1998 | Seidl | 123/41.44 |

FOREIGN PATENT DOCUMENTS

| | | |
|---|---|---|
| 2940427C2 | 4/1985 | Germany . |
| 3517002A1 | 11/1985 | Germany . |
| 6-241042 | 8/1994 | Japan . |

*Primary Examiner*—Willis R. Wolfe
*Assistant Examiner*—Hyder Ali
*Attorney, Agent, or Firm*—Watson Cole Grindle Watson, P.L.L.C.

[57] ABSTRACT

This invention relates to a cooling system for motor vehicles comprising a water pump configured as a radial-flow pump and a thermostat for control of the cooling system, which is installed in a thermostat housing, the water pump having a housing on the inlet side, which is integral with the housing of the thermostat. Simplicity of design is achieved by including a flow directing baffle as part of a connecting piece of the heater return line, which baffle partially encloses the thermostat.

8 Claims, 2 Drawing Sheets

COOLING SYSTEM FOR MOTOR VEHICLES

BACKGROUND OF THE INVENTION

This invention relates to a cooling system for motor vehicles comprising a water pump configured as a radial-flow pump and a thermostat for control of the cooling system, which is installed in a thermostat housing, the water pump having a housing on the inlet side, which is integral with the housing of the thermostat.

DESCRIPTION OF THE PRIOR ART

Cooling systems for internal combustion engines in motor vehicles are expected to meet various requirements. Above all, such a system should have a simple and compact design. Design simplicity will permit low manufacturing cost and failure-proof operation, whilst compactness is essential as the space for installation of ancillary components is subject to a growing number of restrictions. Generally, such a cooling system comprises a coolant pump, which usually is configured as a radial-flow pump and delivers cooling water to the engine block and/or the cylinder head of an internal combustion engine. From the engine block or cylinder head a bypass line directly leads to a thermostat, while another line leads to the thermostat via a radiator. In addition, a heater core is provided, which utilizes the heat of the cooling water to heat the air to be blown into the interior of the vehicle.

In conventional cooling systems a thermostat is often positioned next to the radiator. Below a preset temperature level an expansion element will prevent the cooling water from passing through the radiator, causing it to flow through the bypass line only ("short circuit"). This will quickly warm up the engine after a cold start. When the preset temperature has been reached the expanding element will change in length and open the passage for the cooling water through the radiator, permitting proper cooling of the engine.

In another known variant of a cooling system a thermostat is positioned next to the coolant pump. The housing on the inlet side and on the delivery side of the pump consists of two separate parts, and at least one further part is provided for the thermostat. Such cooling systems work well, but are expensive to produce and assemble.

In WO 96/03574 a cooling system of an internal combustion engine is described, which features a relatively compact arrangement of water pump and thermostat. The water flows towards the thermostat by way of a housing of the shape of a truncated cone, passing essentially along its axis. It has been found, though, that the response obtained with this type of design is comparatively slow. During a cold start the thermostat is closed in order to prevent the cooling water from entering the radiator. Once the engine has reached its operating temperature, however, the thermostat should open in order to ensure sufficient cooling. With the conventional solution it may happen under certain operating conditions that the cooling water will reach its preset temperature comparatively early and exceed it for a certain period until the thermostat has opened. This may lead to undesirable overheating.

SUMMARY OF THE INVENTION

It is an object of the invention to improve the cooling system described above, in order to reduce manufacturing cost while ensuring ease of production and design simplicity. In particular, all efforts are made to ensure a rapid response of the thermostat.

According to the invention this object is achieved by providing a flow directing baffle as integral part of a connecting piece of the heater return line, which baffle partially encloses the thermostat.

Advantageously, a support of the thermostat is made in one piece with a bearing part of the water pump. By configuring the cooling system as proposed by the invention it will be possible to reduce the number of components and to obtain a most compact water pump/thermostat unit in a simple manner.

Molding is facilitated and flow dynamics improved by providing that a chamber on the delivery side of the water pump be partially constituted by the part forming the housing on the inlet side and partially by the bearing part of the pump, and that the gasket plane between the inlet-side housing and the bearing part should extend along the middle plane of the delivery-side chamber.

It is proposed in an especially preferred variant of the invention that a connecting piece be provided for a heater return line, which should be attached to a flange face on the thermostat housing, said face running substantially parallel to the axial direction of the thermostat. The thermostat is directly in the flow path of the coolant coming from the heater return line.

To permit the use of a maximum number of shared components in various mounting situations, it is further proposed that a flow directing baffle be integrated in a mounting element, to which a connecting piece for a heater return line may be attached, i.e., in two different positions. One position of the connecting piece is particularly suited for longitudinal mounting of the engine, whilst the other position is suited for transverse mounting.

A major simplification is achieved by configuring the inlet-side housing as part of the engine block or cylinder head of an internal combustion engine. In this way yet another component is eliminated and tooling expense is reduced, as the cylinder head, for example, must be loaded for tooling in any case.

BRIEF DESCRIPTION OF THE DRAWINGS

The invention will now be described further, with reference to the accompanying drawings, in which.

DESCRIPTION OF THE PREFERRED EMBODIMENT

Figure 1:
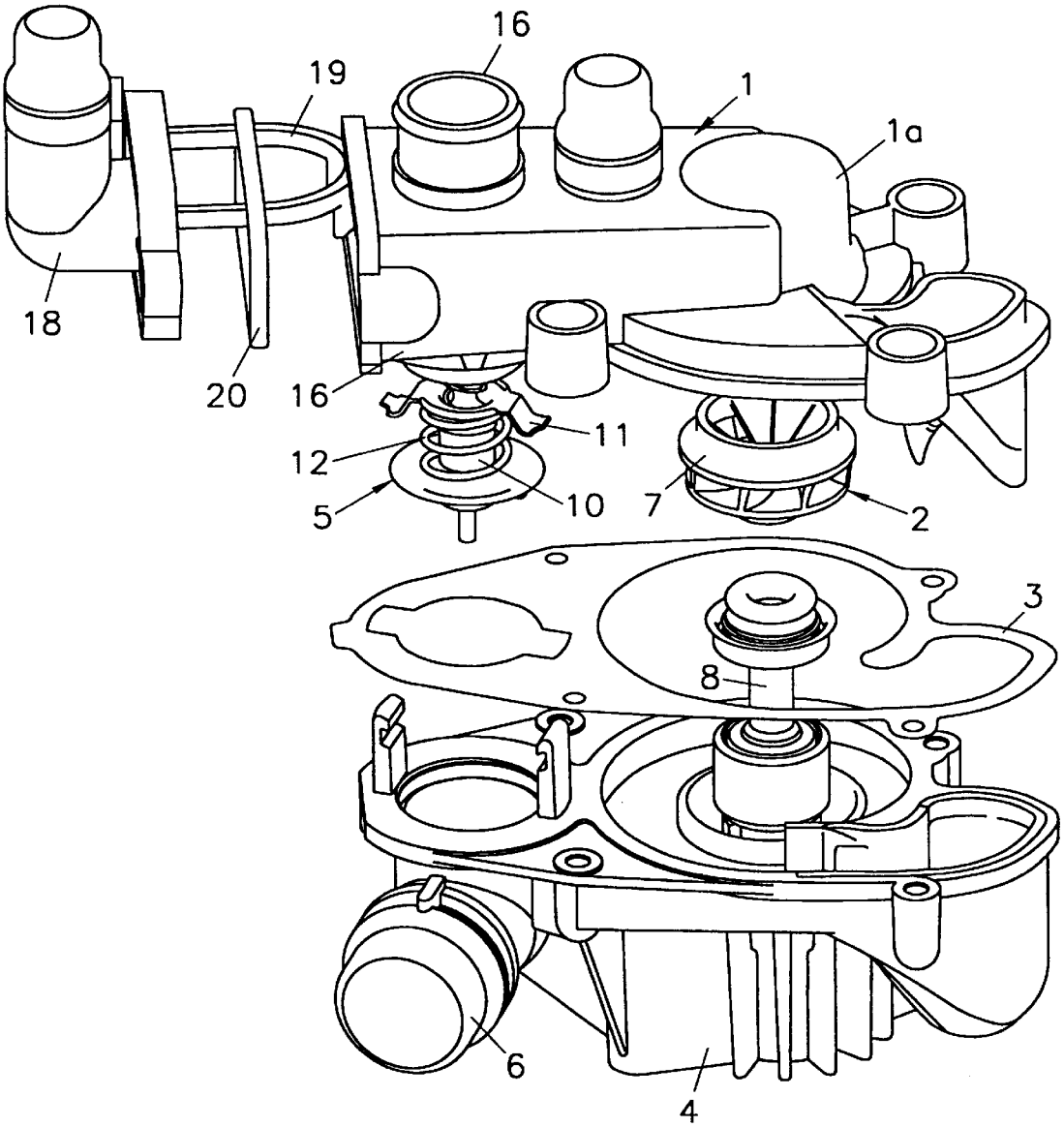
FIG. 1 is an axonometric, exploded view of the substantial part of a cooling system according to the invention.

The water pump/thermostat unit of FIG. 1 comprises a first part 1 constituting the inlet-side housing la of the water pump 2 and the thermostat housing lb integrated in one piece. Via a gasket 3 the bearing part 4 of the water pump 2 is flange-mounted onto the first part 1, which bearing part 4 also serves as support 4*a* for the thermostat 5. A fitting 6 on the bearing part 4 is provided for the return line of the cooling water from the radiator not shown here. An impeller 7 is mounted on a pump shaft 8 by which it is rotated. The chamber on the delivery side of the water pump 2 is partially formed by a recess 9*a* in the bearing part 4 and partially by a recess 9*b* in part 1.

The thermostat 5 features an expanding element 10, which is supported by a bracket 11 held by clips 21. A first spring 12 will press a first poppet valve 15 into closed position. A second spring 14 will load a second poppet valve 15 in closing direction. Springs 12 and 14 are configured as helical compression springs. Poppet valve 13 controls an opening through which cooling water is recirculated from the radiator (not shown) to the water pump 2. Poppet valve 15 controls a bypass fitting 16 via which cooling water is directly recirculated from the engine block or cylinder head (not shown). A lateral flange 17 of part 1 is provided with a connecting piece 18 for the return line from a heater core not shown here. A flow directing baffle 19 is molded integral with the connecting piece 18, which baffle 19 encloses the thermostat 5. Baffle 19 is used to direct the cooling water entering through the poppet valve 15 such that it will reliably flow around the thermostat 5. This will ensure a fast and reliable response of the thermostat in case of a temperature rise of the recirculated cooling water, closing the poppet valve 15 as soon as a preset temperature is exceeded. The use of plastic material for the flow directing baffle 19 will considerably simplify manufacture of part 1 compared to a conventional fin cast integral with it. This will reduce cost considerably.

A gasket 20 is provided to seal the connecting piece 18 against the flange 17.

Figure 2:
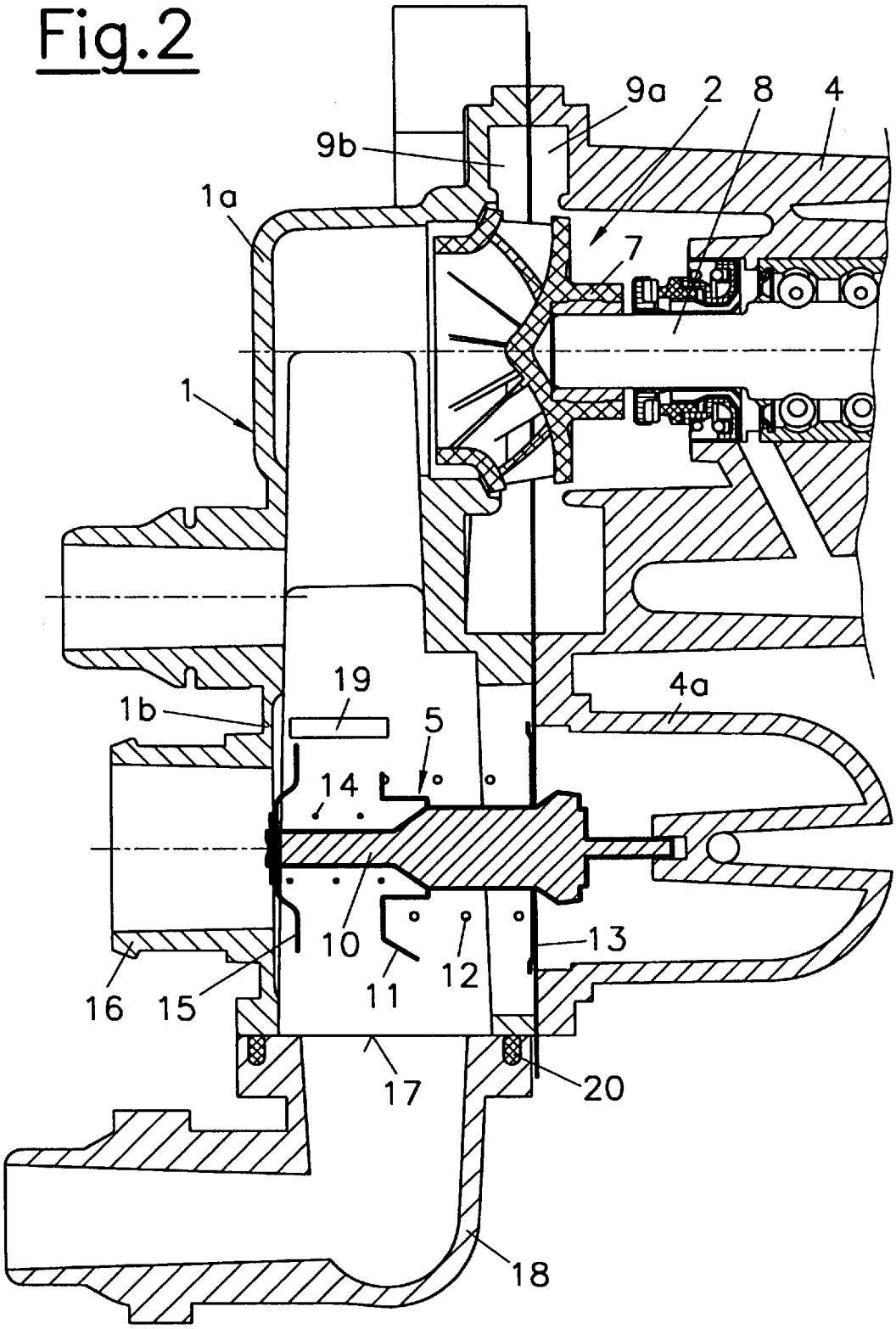
FIG. 2 is a section through the system of FIG. 1.

The flow directing baffle 19 may be molded integral with the connecting piece 18, but could be integrated in a separate mounting element according to an alternative version, which could be combined with the connecting piece 18 in two different positions, for example, by a dovetailed connection. As a consequence, the connecting piece 18 may be attached in different positions using the same components, i.e., in a position in which the connecting piece 18 of FIG. 2 points to the left, or, as an alternative, to the right hand side.

The present invention permits an assembly consisting of water pump and thermostat to be built from a small number of parts involving little manufacturing expense.

What is claimed is:

1. A cooling system for motor vehicles comprising a water pump configured as a radial-flow pump and a thermostat for control of the cooling system, which thermostat is installed in a thermostat housing, the water pump having an inlet-side housing, which is integral with the thermostat housing, wherein a flow directing baffle is provided as an integral part of a connecting piece of a heater return line, which baffle partially encloses the thermostat.

2. A cooling system for motor vehicles comprising a water pump configured as a radial-flow pump and a thermostat for control of the cooling system, which thermostat is installed in a thermostat housing, a support of the thermostat is made in one piece with a bearing part of the water pump, the water pump having an inlet-side housing, which is integral with the thermostat housing, wherein a flow directing baffle is provided as an integral part of a connecting piece of a heater return line, which baffle partially encloses the thermostat.

3. A cooling system for motor vehicles comprising a water pump configured as a radial-flow pump and a thermostat for control of the cooling system, which thermostat is installed in a thermostat housing, the water pump having an inlet-side housing, which is integral with the thermostat housing, wherein a flow directing baffle is provided as an integral part of a connecting piece of a heater return line, which baffle partially encloses the thermostat and wherein said connecting piece of said heater return line is attached to a flange face on the thermostat housing, said face running essentially parallel to the axial direction of the thermostat.

4. A cooling system for motor vehicles comprising a water pump configured as a radial-flow pump and a thermostat for control of the cooling system, which thermostat is installed in a thermostat housing, the water pump having an inlet-side housing, which is integral with the thermostat housing, wherein a flow directing baffle is provided as an integral part of a connecting piece of a heater return line, which baffle partially encloses the thermostat and wherein the connecting piece of the heater return line is oriented such that the flow towards the thermostat is essentially at a right angle to the thermostat axis.

5. A cooling system for motor vehicles comprising a water pump configured as a radial-flow pump and a thermostat for control of the cooling system, which thermostat is installed in a thermostat housing, the water pump having an inlet-side housing, which is integral with the thermostat housing, wherein a flow directing baffle is provided as an integral part of a connecting piece of a heater return line, which baffle partially encloses the thermostat and wherein the flow directing baffle is integrated in a mounting element, to which the connecting piece for the heater return line may be attached in two different positions.

6. A cooling system for motor vehicles comprising a water pump configured as a radial-flow pump and a thermostat for control of the cooling system, which thermostat is installed in a thermostat housing, the water pump having an inlet-side housing, which is integral with the thermostat housing, wherein a flow directing baffle is provided as an integral part of a connecting piece of a heater return line, which baffle partially encloses the thermostat and wherein the inlet-side housing is configured as part of the engine block or cylinder head of an internal combustion engine.

7. A cooling system for motor vehicles comprising a water pump configured as a radial-flow pump and a thermostat for control of the cooling system, which thermostat is installed in a thermostat housing, the water pump having an inlet-side housing, which is integral with the thermostat housing, wherein a flow directing baffle is provided as an integral part of a connecting piece of a heater return line, which said directing baffle partially encloses the thermostat and wherein a delivery-side chamber of the water pump is partially constituted by the part forming the inlet-side housing and partially by a bearing part.

8. A cooling system as claimed in claim 7, wherein a gasket plane between the inlet-side housing and the bearing part extends essentially along the middle plane of the delivery-side chamber.

* * * * *